United States Patent [19]

Valditerra

[11] 4,403,430

[45] Sep. 13, 1983

[54] PLOUGH WITH LATERAL EJECTORS FOR DISPLACING RAILWAY TRACK BALLAST

[75] Inventor: Sergio Valditerra, Alessandria, Italy

[73] Assignee: Matisa Materiel Industriel S.A., Switzerland

[21] Appl. No.: 227,681

[22] Filed: Jan. 29, 1981

[30] Foreign Application Priority Data

Oct. 22, 1979 [IT] Italy ..... 69052 A/79

[51] Int. Cl.[3] ..... E02F 5/22

[52] U.S. Cl. ..... 37/104; 37/217

[58] Field of Search ..... 37/104, 105, 106, DIG. 18, 37/198, 212, 215, 216, 217, 269, 272, 274, 280, 281; 172/40; 171/16, 71–81

[56] References Cited

U.S. PATENT DOCUMENTS

| | | | |
|---|---|---|---|
| 203,377 | 5/1878 | Royal | 37/217 X |
| 615,688 | 12/1898 | Duff | 37/212 |
| 1,328,026 | 1/1920 | Wojtasiewicz | 37/212 |
| 2,214,207 | 9/1940 | Shipley | 37/217 |
| 2,886,904 | 5/1959 | Kershaw | 37/104 |
| 2,914,867 | 12/1959 | Scheuchzer et al. | 37/104 |
| 3,387,890 | 6/1968 | Haynes | 172/40 X |
| 3,605,297 | 9/1971 | Kershaw | 37/217 X |
| 3,889,405 | 6/1975 | Ranini | 172/40 X |
| 3,967,395 | 7/1976 | Stewart | 37/104 |
| 4,227,324 | 10/1980 | Theurer . | |

FOREIGN PATENT DOCUMENTS

| | | | |
|---|---|---|---|
| 710650 | 6/1954 | United Kingdom | 37/DIG. 18 |

*Primary Examiner*—Edgar S. Burr
*Assistant Examiner*—Moshe I. Cohen
*Attorney, Agent, or Firm*—Robert E. Burns; Emmanuel J. Lobato; Bruce L. Adams

[57] ABSTRACT

A plough to be applied to a machine for rehabilitating a railway track, for performing the operation consisting in displacing the ballast to be renewed. Lateral ejectors are applied to the lower portion of the plough and actuated alternatively for breaking the compact ballast and push the gravel so as to gradually accumulate same on the sides and afford and easy forward travel of the plough for making a relatively deep cutting into which the new ties can be laid without requiring a subsequent sinking thereof. The lateral ejectors are actuated two at a time, one to the right and the other to the left, for compensating side stress. A possible mechanism for actuating the lateral ejectors comprises rockers having unequal arms and actuated by a hydraulic cylinder.

13 Claims, 6 Drawing Figures

PLOUGH WITH LATERAL EJECTORS FOR DISPLACING RAILWAY TRACK BALLAST

FIELD OF THE INVENTION

The present invention relates to a plough of the type applied to machines for the rehabilitation of railway tracks, for displacing the pre-existing compact ballast, after removing the old rails and ties, and preparing the bed for laying new ties.

BACKGROUND OF THE INVENTION

Known ploughs for this purpose act by simple wedging into the ballast, due to the forward motion of the machine to which the plough is attached, and undergo a very strong drag, either because the gravel of the old ballast has become compact due to the ramming action exerted by the train traffic and to the bonding action of mud, metal powders and other substances deposited upon the ballast, or because the low operating speed of the tie tamper does not promote the development of a regular flow of gravel displaced by the plough. Consequently, it is not possible to make with such ploughs a cutting of substantial depth. In practice, one must limit oneself to equalizing the ballast by pouring into the furrows left by the removed ties the gravel previously located between adjacent ties, while pushing laterally only a small amount of gravel. The new ties are thus laid at a level higher than necessary and a special machine must subsequently be used for excavating the gravel under the new ties in order to lower their level to the extent just necessary for restoring the proper laying level after the packing operation causing the ties to be raised a few centimeters. In many cases it is required that the level for laying the new ties be lower than that of the old ties, due to the adoption of higher ties and/or rails, and to the necessity of keeping the track plane at the same previous level, subordinate to the height of the overhead line, to the tunnel gage, to level crossings, and the like.

SUMMARY OF THE INVENTION

It is the object of the present invention to improve the efficiency of a plough of the above-mentioned type, so that with it a furrow can be excavated without difficulty to a depth such that it can accommodate the new ties, without requiring any further sinking operation, even in case ties higher, and rails heavier, than the previously laid ones are laid.

This object is attained, according to the invention, by the fact that apertures are formed in the lower portions of the plough blades, that each aperture has mounted therein an ejector having substantially the motion of a piston adapted to slide across the direction of travel of the plough, and that there is provided a mechanism for imparting to each ejector a reciprocating motion between an inner position in which the ejector does not protrude appreciably from the corresponding plough blade, and an outer position in which the ejector protrudes considerably in relation to said blade.

By virtue of these features, each ejector, during its movement from the inner position to the outer position, pushes positively a mass of ballast gravel to one side while scattering and displacing same, without deriving its energy from the plough's forward movement and therefore by exerting a force which may opportunely be preset when intially projecting and adjusting the driving mechanism. During the next step in which the ejector is retracted, it will not counteract the plough's forward travel. Each mass of gravel displaced by an ejector is subsequently reworked by the next ejector which, due to the plough blade divergence, operates on a greater width, until the ballast is discharged out to the sides of the cutting excavated by the plough for laying new ties. With these repeated positive-thrust actions exerted on the masses of ballast to be displaced, the plough is capable of excavating a furrow having a depth much greater than that obtainable without using the ejectors, and the excavated depth can thus be so selected that any subsequent sinking of the laid ties can be dispensed with.

In order to avoid the application of excessive lateral forces to the plough supporting machine, the driving mechanism is preferably so arranged that while a predetermined number of ejectors are moved to one side a corresponding number of other ejectors are moved toward the opposite side, thus balancing the lateral forces at least approximately.

The deeper excavation required centrally of the cutting for discharging the central areas of the ties may be cut either by a point section, of greater depth, of the plough blades, as conventional, or by a horizontal rotary cutter adapted to be driven in one or the other direction according as it is desired to discharge a greater amount of ballast on one or the other side of the cutting.

BRIEF DESCRIPTION OF DRAWINGS

These and other features and advantages of the plough according to the invention will be better apparent from the following description of exemplary and non-limiting forms of embodiment illustrated diagrammatically in the attached drawings, in which.

DESCRIPTION OF PREFERRED EMBODIMENT

Figure 6:
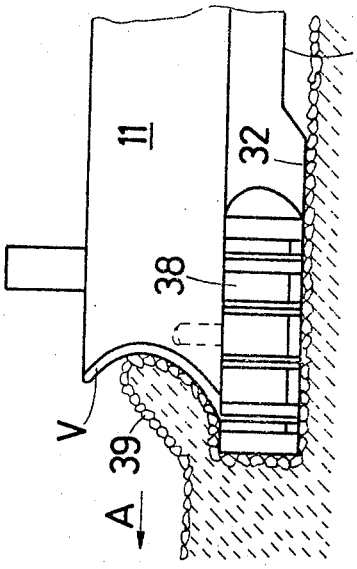
FIG. 6 is a fragmentary side elevational view of the modified embodiment of FIG. 5.

The reference numeral 1 (FIG. 2) designates a longitudinal beam of the frame structure of a machine for rehabilitating railway tracks, of a type known per se, to which, in this example, the plough of the invention is mounted. In this machine, the reference numeral 2 designates a toothed wheel which, by cooperating with guide means 3, is used for stripping the old ties 5 from the old ballast, thus leaving empty cavities 6. The machine also comprises a device for laying the new ties 7; of this device, side plates 8 for preventing the heaps of gravel formed laterally by the plough from crumbling are visible. These heaps then fall partly behind the end of plates 8, thus holding in position the freshly laid new ties 7. The plough is suspended from the structure 1 by means of supports 9. All these members, shown in dash and dot lines, are known. Also shown in dash and dot lines is the level 10 of the deepest cutting obtainable with a plough of known type subject to the limitations set forth hereinabove.

The reference numeral 11 designates the two blades set at an angle to constitute the plough of this invention. They are supported in the known fashion by a frame 12 suspended from supports 9. The frame 12 also carries laterally plates 13 constituting the extensions, to a predetermined length and parallel to the direction of travel A of the plough, of the rear ends of blades 11, for supporting the lateral heaps of ballast which, after having been released by plates 13, will still be temporarily supported by the aforesaid side plates 8. The plough forming blades 11 have as conventional a concave profile of which the upper portions, facing outwardly in the fashion of mold-boards, push the heaps of ballast formed by the plough towards the track sides.

In the lower portion of blades 11, more particularly in the portion thereof intended for penetrating into the ballast 4 to be displaced, apertures 14 are formed which, in this example, are of substantially square configuration and four in number. The pair of apertures nearest to the plough vertex V are occupied by a pair of ejectors 16 adapted to slide transversely between guide means 17 and interconnected by a rod 18 so that the two ejectors 16 (forming an assembly of two substantially square-sectioned pistons) can move bodily in the transverse direction T. Similarly, the second pair of apertures 14 are occupied by another pair of ejectors 19 also interconnected by a rod 20 and guided for movement in the transverse direction T. The third and fourth pairs of apertures 14 are likewise occupied by third and fourth pairs of ejectors 21 and 23, respectively, interconnected by rods 22 and 24, respectively.

The rods 18 and 20 are coupled to a rocker 25 having unequal arms, which is fulcrumed to the plough fixed frame structure and provided with a lever arm 26. Similarly, the rods 22 and 24 are coupled to a rocker 27 having unequal arms, which is fulcrumed to the plough fixed frame structure and provided with a lever arm 28. The lever arms 26 and 28 are interconnected by a rod 29 coupled to the piston rod of a hydraulic cylinder 30 reacting with its opposite end against the frame 12.

As can be understood, when the hydraulic cylinder 30 is actuated alternately in both directions the rod 29 is reciprocated and this motion transmitted through the lever arms 26 and 28 is converted into an oscillatory motion of rockers 25, 27 and into an alternating movement of translation in the transverse direction of the various ejectors 16, 19, 21 and 23, so that while two of them move on one side the other two move on the opposite side. Moreover, the difference between the various lever arms is such that the amplitude of the movement increases from ejector 16 to ejector 23.

Each time an ejector moves outwarly and thus protrudes from the relevant aperture 14 of blade 11, it applies a transverse force to one section of the old ballast, thus breaking up same and displacing a predetermined mass of gravel towards one side of the track. When the ejector subsequently retracts, it leaves a free space in which the plough can move without having to overcome any resistance. The previously displaced mass of gravel is then taken over by the next ejector and subsequently moved laterally with a greater amplitude of movement for compensating the increased amount of gravel accumulating in front of the successive ejectors. Thus, all the gravel of the ballast is gradually transferred to the track sides, where it is temporarily retained by the plates 13 preventing it from falling-in inwardly.

The arrangement of ejectors coupled by pairs by rods permits simplifying the manufacturing operations and the driving means, and the actuation of the successive ejectors in opposite directions alternately ensures the balancing of at least the greater part of the lateral forces. In the form of embodiment illustrated, the force applied by the hydraulic cylinder 30 is borne by the supporting structure 12, but according to a modified embodiment (not shown), which is particularly useful when it is desired to relieve the structure of this force, the hydraulic cylinder may be substituted for the rod 29, to produce oscillations in opposite directions of the rockers 25 and 27 and loading the structure only in the areas of the pivotal mounting of said rockers.

Figure 2:
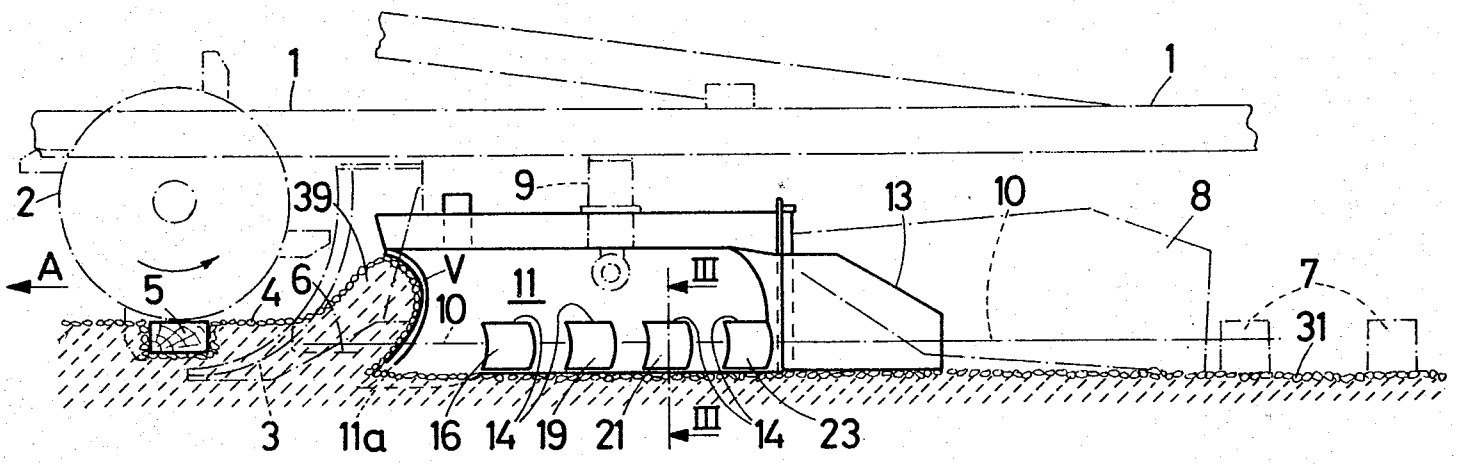
FIG. 2 illustrates on a still smaller scale a side elevational view thereof, together with some component elements of a machine for rehabilitating railway tracks, to which the plough is mounted.

The improved efficiency of the plough of the invention permits making a full-depth cutting, at a level 31, for laying the new ties 7 into it, even if they are thicker, without requiring any subsequent excavation thereunder, whereas with a conventional plough the excavation could not be carried out to a level lower than that shown at 10 by way of comparison in FIG. 2, which makes it necessary to use subsequently a suitable excavating appliance.

Figure 4:
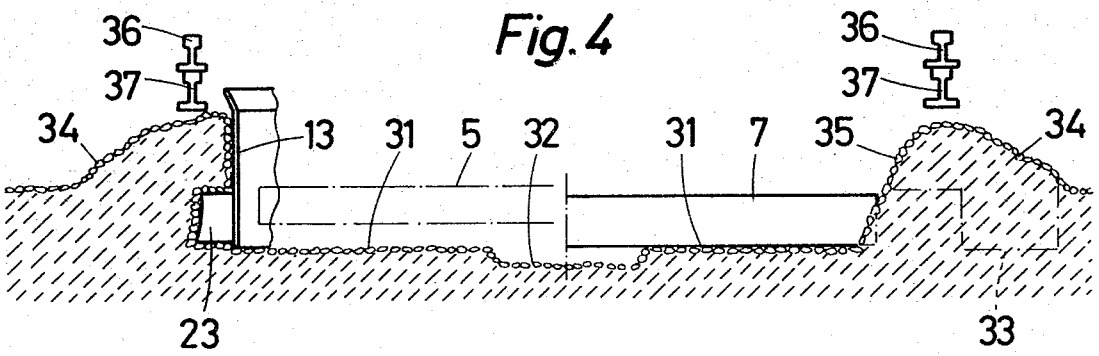
FIG. 4 illustrates a cross section of the cutting formed by the plough of the invention.
Figure 3:
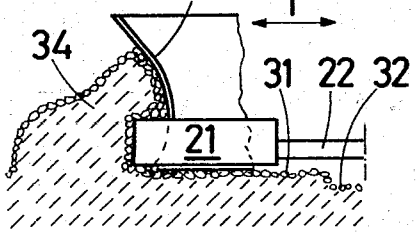
FIG. 3 shows a fragmentary vertical cross-section taken along the line III—III of FIG. 2.

Preferably, to further facilitate the operation, with a pair of auxiliary ploughs, which may be mounted to the same track removing machine or other machine to be passed on the track before this machine, small cuttings like the one shown in dash and dot lines at 33 in FIG. 4 are made laterally of the track for receiving one fraction of the gravel displaced by the plough, while the excess gravel forms heaps 34 retained temporarily by plates 13 and then by plates 8; after the passage thereof, as shown in the right-hand portion of FIG. 4, the heap 34 falls partially, to form a slope 35 surrounding the ends of the newly laid ties 7, and hold same in position. The heaps 34 are formed below the level of the new rails 37 held temporatily in position by the machine, in known fashion, above and laterally of the cutting, and supporting the old rails 36 to be removed, as shown in FIG. 4.

Figure 5:
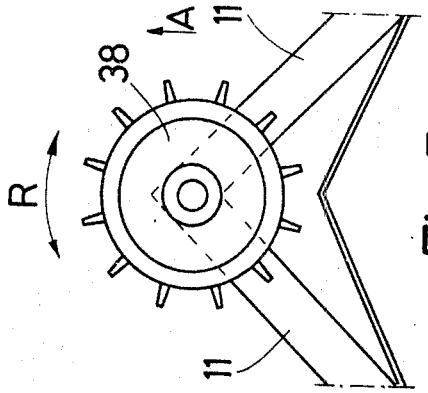
FIG. 5 is a fragmentary plan view from beneath of a modified embodiment.
Figure 1:
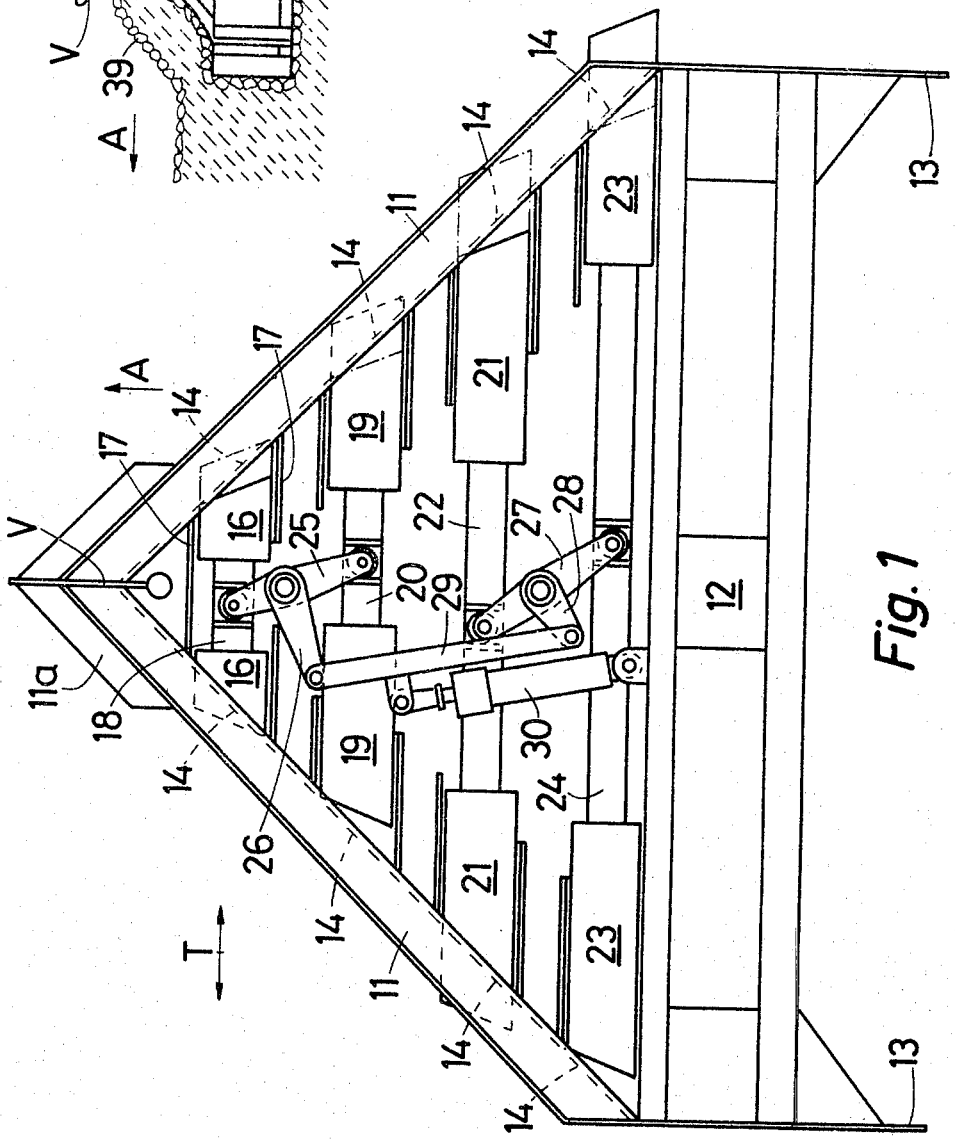
FIG. 1 is a plan view on a reduced scale of a plough according to the invention.

As already known, the central area of the cutting for laying the ties 7 must be lowered at 32 to a level lower than the laying level 31, for relieving the central portion of the ties of the bearing load. This can be achieved, as usual, by providing the plough blades 11 with a front section 11*a* extending at level 32. The same effect can also be obtained, according to the invention, by mounting beneath the front end of plough 11 a horizontal cutter 38 (FIGS. 5 and 6) rotatably driven from an electric or hydraulic motor. With a similar cutter it is also possible to transfer the broken ballast mainly to one side, if desired, by driving the cutter in a corresponding direction of rotation R, and in any case the height of the gravel heap 39 formed in front of the plough vertex V and consequently the drag are reduced.

It is understood that various modifications may be brought to the forms of embodiment described herein. Thus, for example, the shape, number and arrangement of the ejectors may vary, as well as the nature and arrangement of the ejector drive means. These may include kinematic means extending from a single power unit, as in the example described herein, or alternately several power sources may be used which are coupled directly or indirectly to said ejectors. The power sources may advantageously consist of hydraulic cylinders, considering the presence of a hydraulic system on board track rehabilitating machines; however, also sources of mechanical or electro-mechanical power are applicable. Corresponding ejectors disposed on either side of the plough could also be driven in opposite directions instead of being interconnected by a rod.

These and other modifications and any substitution of technically equivalent means may be made to what has been described and illustrated by way of example, without inasmuch departing from the field of the invention and the range of the present patent.

I claim:

1. A plow for laterally displacing compacted ballast of railway road beds, comprising:

a vehicle having means for propelling said vehicle along the road bed, a V-shaped plow mounted on said vehicle and having an apex and plow blades which extend at an angle rearwardly and laterally outwardly from the apex of said plow, each of said blades having spaced apertures in lower portions thereof, a plurality of ejectors disposed in said apertures and movable transversely of the direction of movement of said vehicle between a retracted position and an extended position in which they project laterally outwardly from said blades, and power means for intermittently moving said ejectors laterally between said retracted position and said extended position as said plow is moved forwardly by said vehicle.

2. A plow according to claim 1, in which said ejectors comprise pairs of ejectors of which the ejectors of a pair are disposed respectively in apertures of opposite blades of the plow and are joined with one another to move as a unit.

3. A plow according to claim 1, in which said means for moving said ejectors comprises means for moving some ejectors with a longer stroke than other ejectors.

4. A plow according to claim 1, in which ejectors at one side of said plow are disposed at least approximately symmetrically with respect to ejectors at the opposite side of said plow.

5. A plow according to claim 1, further comprising a horizontal rotary toothed cutting wheel mounted at the apex of said plow and extending to a depth greater than the cutting depth of said plow blades and means for selectively rotating said cutting wheel in one or another direction of rotation.

6. A plow according to claim 1, in which said ejectors have outer end faces which are inclined rearwardly and laterally outwardly.

7. A plow according to claim 6, in which said outer end faces of said ejectors are inclined at a smaller angle than said plow blades relative to a central longitudinal axis of said plow.

8. A plow according to claim 1, in which said means for moving said ejectors comprises means for moving a like number of ejectors outwardly from opposite blades of said plow at the same time to balance, at least approximately, lateral forces acting on said plow.

9. A plow according to claim 8, in which said ejectors comprise pairs of ejectors with the ejectors of a pair disposed respectively in apertures of opposite blades of the plow and joined with one another to move as a unit, said means for moving said ejectors comprising means for moving one pair of ejectors in one direction and another pair of ejectors in an opposite direction.

10. A plow according to claim 1, in which said means for moving said ejectors comprises linkage means interconnecting said ejectors for movement in unison with one another.

11. A plow according to claim 10, in which said linkage means comprises pivoted levers with arms of different length to move some ejectors with a longer stroke than others.

12. A plow according to claim 1, in which said plow has guide means extending inwardly of said blades for slidably guiding said ejectors in reciprocatory movement relative to said blades.

13. A plow according to claim 12, in which said guide means have guide surfaces extending at least approximately perpendicularly of the central longitudinal axis of the plow.

* * * * *